US007845429B2

(12) United States Patent
Guidry et al.

(10) Patent No.: US 7,845,429 B2
(45) Date of Patent: Dec. 7, 2010

(54) DETERMINING DRILLSTRING NEUTRAL POINT BASED ON HYDRAULIC FACTOR

(75) Inventors: Jonathan Guidry, Meylan (FR); XiaoYan Shi, Beijing (CN); Richard Meehan, Beijing (CN); Joseph Fang, Beijing (CN); Li Lan, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 67 days.

(21) Appl. No.: 11/963,059

(22) Filed: Dec. 21, 2007

(65) Prior Publication Data

US 2009/0159333 A1 Jun. 25, 2009

(51) Int. Cl.
*E21B 47/00* (2006.01)

(52) U.S. Cl. ..... 175/40

(58) Field of Classification Search ..... 175/40, 175/45, 48, 50; 702/6, 9, 11
See application file for complete search history.

(56) References Cited

U.S. PATENT DOCUMENTS 4,627,502 A * 12/1986 Dismukes ..... 175/320
4,794,534 A * 12/1988 Millheim ..... 702/9
6,760,665 B1 * 7/2004 Francis ..... 702/6
6,785,641 B1 * 8/2004 Huang ..... 703/7
7,027,925 B2 * 4/2006 Terentyev et al. ..... 702/9
7,059,429 B2 * 6/2006 Taylor et al. ..... 175/57
7,546,884 B2 * 6/2009 Veeningen et al. ..... 175/40
2004/0256152 A1 * 12/2004 Dashevskiy et al. ..... 175/25
2005/0063251 A1 * 3/2005 Guidry et al. ..... 367/35
2005/0211468 A1 * 9/2005 Veeningen et al. ..... 175/24
2007/0005316 A1 * 1/2007 Paez ..... 703/10
2008/0156531 A1 * 7/2008 Boone et al. ..... 175/27

* cited by examiner

*Primary Examiner*—David J Bagnell
*Assistant Examiner*—Blake Michener
(74) *Attorney, Agent, or Firm*—Hoffman Warnick LLC

(57) ABSTRACT

A solution for determining a neutral point of a drillstring in drilling a borehole is disclosed. The solution includes receiving depth-time log data for drilling the borehole with the drillstring, the depth-time log data including data related to a torque and drag factor and data related to a hydraulic factor; and determining the neutral point of the drillstring at a time point during the drilling based on the torque and drag factor and the hydraulic factor.

2 Claims, 4 Drawing Sheets

DETERMINING DRILLSTRING NEUTRAL POINT BASED ON HYDRAULIC FACTOR

FIELD OF THE INVENTION

The disclosure relates in general to reservoir development, and more particularly to determining a neutral point of a drillstring in drilling a borehole based on hydraulic and/or torque and drag factors.

BACKGROUND OF THE INVENTION

In oil reservoir development, a drillstring is used to drill a borehole (well). The term "drillstring" refers to the combination of the drillpipe, the bottomhole assembly and any other tools used to make the drill bit turn at the bottom of the wellbore. During the drilling, the neutral point of the drillstring needs to be considered for various reasons, such as stress reduction and management. A neutral point is the point at which the drillstring moves from a state of compression stress to a state of tension stress. Components of the drillstring below the neutral point are in compression stress such that they need to have high bending stiffness to avoid, for example, buckling. In addition, if there is a jarring device in the drillstring, the jarring device needs to be positioned either below or above the neutral point depending on the type of the jarring device (i.e., compression or tension) such that, for example, accidental jar firing can be avoided.

Conventionally, the neutral point is determined and considered in bottomhole assembly (BHA) design in the well plan stage. A BHA refers to the lower portion of a drillstring, including, if any, from the bottom up in a vertical well, the bit, bit sub, a mud motor (in certain cases), stabilizers, drill collars, heavy-weight drillpipe, jarring devices ("jars") and crossovers for various threadforms. The neutral point is calculated using a torque and drag engine. Conventionally, the inputs to a torque and drag engine include the designed BHA, wellbore geometry, survey (e.g., the type of wellbore) and the estimations/simulations of various factors related to the drilling process. However, the estimation/simulation may deviate from the situations in the actual drilling. As such, in the drilling, the actual neutral point may be different than the pre-calculated neutral point. In addition, in the actual drilling process, the neutral point may move due to, e.g., changes in the values of the torque and drag factors, and other relevant factors.

SUMMARY OF THE INVENTION

A first aspect of the invention is directed to a method for determining a neutral point of a drillstring in drilling a borehole, the method comprising: receiving depth-time log data for drilling the borehole with the drillstring, the depth-time log data including data related to a torque and drag factor and data related to a hydraulic factor; and determining the neutral point of the drillstring at a time point during the drilling based on the torque and drag factor and the hydraulic factor.

A second aspect of the invention is directed to a system for determining a neutral point of a drillstring in drilling a borehole, the system comprising: means for receiving depth-time log data for drilling the borehole with the drillstring, the depth-time log data including data related to a torque and drag factor and data related to a hydraulic factor; and means for determining the neutral point of the drillstring at a time point during the drilling based on the torque and drag factor and the hydraulic factor.

A third aspect of the invention is directed to a computer program product for determining a neutral point of a drillstring in drilling a borehole, comprising: computer usable program code stored in a computer useable medium, which, when executed by a computer system, enables the computer system to: receive depth-time log data for drilling the borehole with the drillstring, the depth-time log data including data related to a torque and drag factor and data related to a hydraulic factor; and determine the neutral point of the drillstring at a time point during the drilling based on the torque and drag factor and the hydraulic factor.

A fourth aspect of the invention is directed to a method of providing a system for determining a neutral point of a drillstring in drilling a borehole, the method comprising: at least one of creating, maintaining, deploying and supporting a computer infrastructure operable to: receive depth-time log data for drilling the borehole with the drillstring, the depth-time log data including data related to a torque and drag factor and data related to a hydraulic factor; and determine the neutral point of the drillstring at a time point during the drilling based on the torque and drag factor and the hydraulic factor.

Other aspects and features of the present invention, as solely defined by the claims, and additional advantages of the invention will become apparent to those skilled in the art upon reference to the following non-limited detailed description taken in conjunction with the provided figures.

BRIEF DESCRIPTION OF THE DRAWINGS

The disclosure is illustrated by way of example and not intended to be limited by the figures of the accompanying drawings in which like references indicate similar elements and in which.

Figure 1:
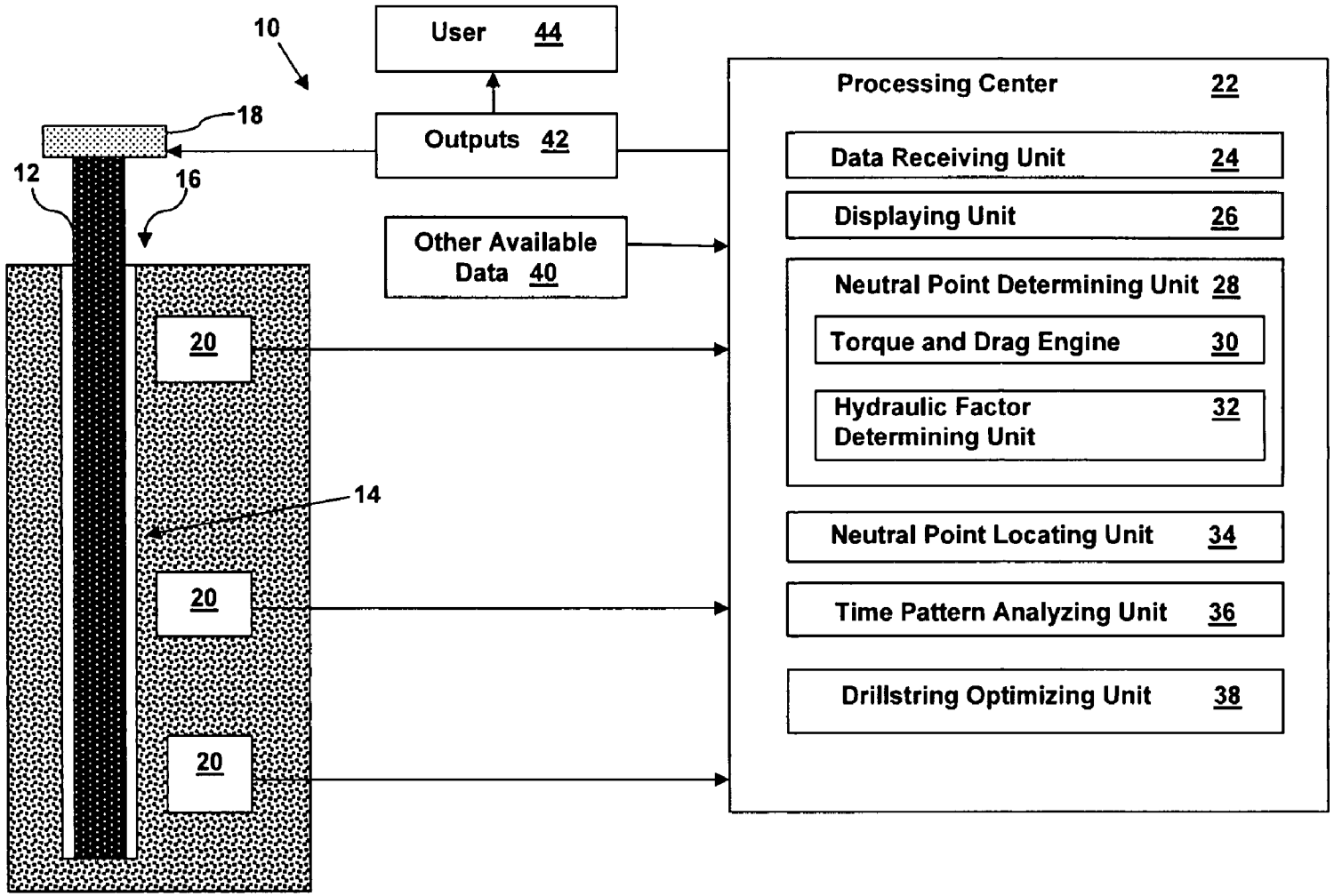
FIG. 1 shows schematically an illustrative system.

It is noted that the drawings are not to scale.

DETAILED DESCRIPTION OF THE DISCLOSURE

Advantages and features of the present invention may be understood more readily by reference to the following detailed description of exemplary embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

1. SYSTEM OVERVIEW

Referring to FIG. 1, a schematic diagram of an illustrative system 10 for determining a neutral point of a drillstring 12 in drilling a borehole 14 in a reservoir 16 is shown. In FIG. 1, borehole 14 is shown as a vertical well, but may also be other type of wells, such as a deviated well including a horizontal well. Reservoir 16 may include any reservoir including but not limited to oil reservoir, gas reservoir, coal reservoir, and underground water reservoir. Drillstring 12 is controlled by a control mechanism 18, which may be integrated to drillstring 12 or may be separated therefrom. A measurement device(s) 20 is positioned along borehole 14 to obtain information (data) related to the drilling process, e.g., openhole log data. Measurement device 20 may be any solution to obtain the required information. In the description herein, a "solution" refers to any now known or later developed approaches to achieve a goal. For example, measurement device 20 may include portable rotary torque meters, weight indicators, log devices, sink probes, observation probe, and/or the like. As is appreciated, measurement devices 20 may be positioned along borehole 14 and/or may proceed into drilled borehole 14 along with drillstring 12. FIG. 1 shows that measurement devices 20 are positioned in the earth formation of reservoir 16, which is not necessary. Measurement device 20 may be positioned within borehole 14.

Information obtained by measurement device 20 is communicated to a processing center 22 via any communication solution. Processing center 22 includes a data receiving unit 24; a displaying unit 26; a neutral point determining unit 28 including a torque and drag engine 30 and a hydraulic factor determining unit 32; a neutral point locating unit 34; a time pattern analyzing unit 36; and a drillstring optimizing unit 38.

According to an embodiment, processing center 22 may be implemented by a computer system. The computer system can comprise any general purpose computing article of manufacture capable of executing computer program code installed thereon to perform the process described herein. The computer system can also comprise any specific purpose computing article of manufacture comprising hardware and/or computer program code for performing specific functions, any computing article of manufacture that comprises a combination of specific purpose and general purpose hardware/software, or the like. In each case, the program code and hardware can be created using standard programming and engineering techniques, respectively.

Additional to the data communicated from measurement device 20, processing center 22 may also collect other available data 40 such as a bottomhole assembly design for drillstring 12.

Outputs 42 of processing center 22 may be communicated to a user 44 and/or control mechanism 18 to act accordingly. For example, control mechanism 18 may manipulate drillstring 12 to move/locate the neutral point thereof to a desired position. User 44 may analyze a time related pattern of the neutral point staying on a component of drillstring 12 for further updating the drillstring design.

It should be appreciated that components of processing center 22 may be located at different locations or may be located at the same location. The operation of processing center 22 is described in detail herein.

2. OPERATION METHODOLOGY

Figure 2:
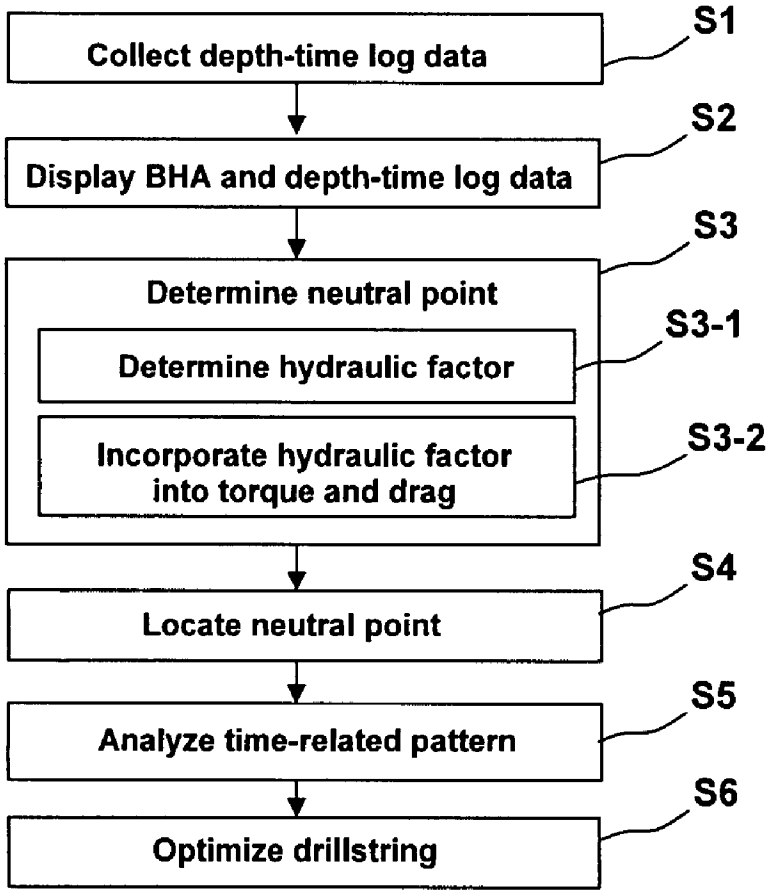
FIG. 2 shows embodiments of an operation of a processing center.

FIG. 2 shows embodiments of the operation of processing center 22. In process S1, data receiving unit 24 receives/collects information from measurement device 20. The information may include depth-time log data of drilling borehole 14 with drillstring 12. The depth-time log data may include data related to a torque and drag factor and data related to a hydraulic factor. A "torque and drag factor" refers to a factor used in a torque and drag engine to calculate a neutral point of drillstring 12. Data related to a torque and drag factor refers to data that is required to determine a torque and drag factor. For example, an effective weight (buoyed weight) may be a torque and drag factor in determining the neutral point, and mud density of the formation of reservoir 16 may be data required for calculating the effective weight. A "hydraulic factor" refers to a hydraulic property of the earth formation of reservoir 16 which may be used in determining the neutral point of drillstring 12 as described herein. Data related to a hydraulic factor refers to data required to calculate the hydraulic factor. For example, an effective density may be a hydraulic factor in determining the neutral point of drillstring 12, and a bottoms-up time ($T_{bu}$), an annular volume ($V_{bu}$), a rate of penetration (dD/dt) may be data required to calculate the effective density. According to an embodiment, the providing and receiving of information from measurement device 20 may be implemented in substantially real time. Any solution may be used to implement the substantially real time data providing and receiving, such as Integrated Drilling Evaluation and Logging (Ideal) and Real-time Monitoring and Data Delivery (Interact).

In process S1, data receiving unit 24 may also receive data from other available data 40. For example, the bottomhole assembly design of dringstring 12 may be collected for further processing. For example, data receiving unit 24 may receive data regarding the components of drillstring 12, which may be processed by, e.g., a BHA editor, to generate a BHA sketch.

Figure 3:
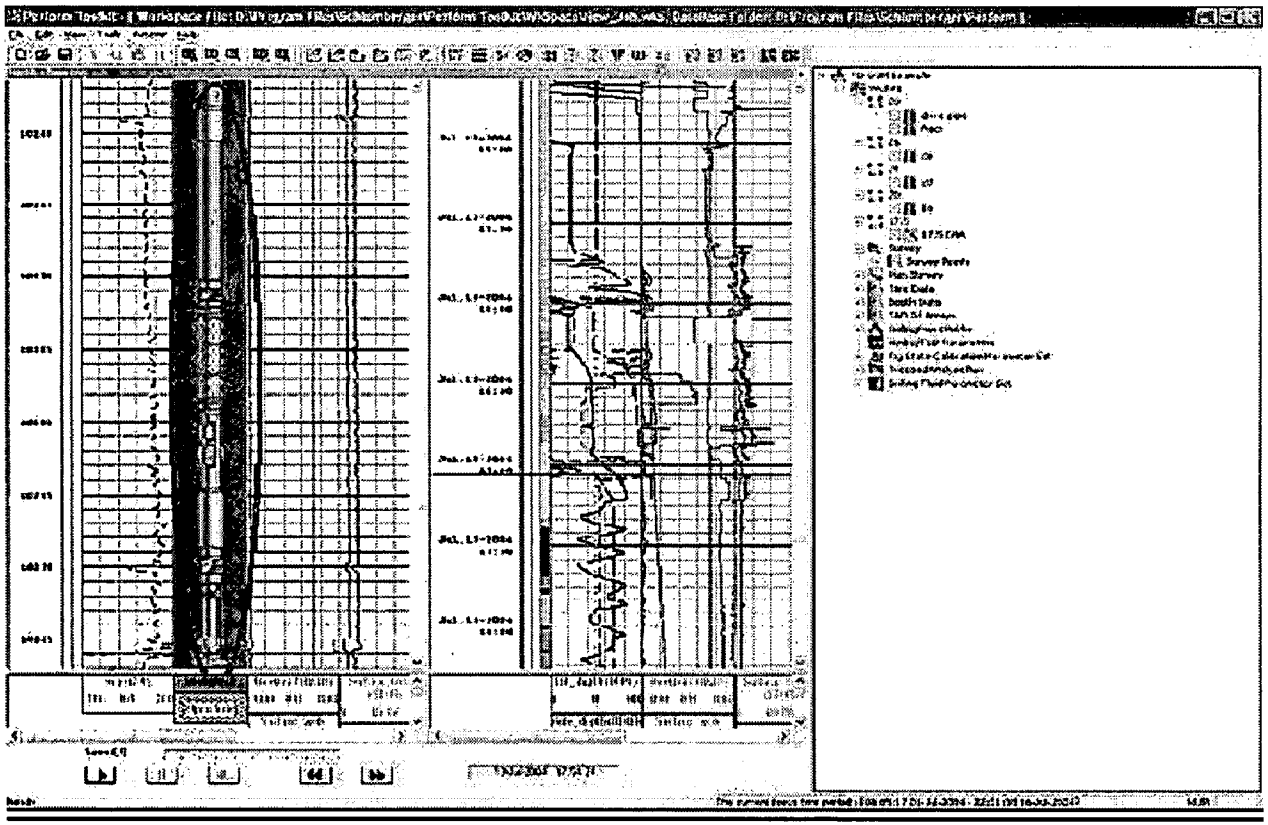
FIG. 3 shows an example of displaying a bottomhole assembly sketch and depth-time log data.

In process S2, displaying unit 26 may display a sketch of the BHA together with the received depth-time log data. Any solution may be used to implement the displaying. For example, FIG. 3 provides a screenprint of displaying an exemplary BHA side by side with exemplary depth-time log data.

In process S3, neutral point determining unit 28 determines the neutral point of drillstring 12 based on the torque and drag factor(s) and the hydraulic factor(s). According to an embodiment, a determined hydraulic factor may be incorporated into a torque and drag calculation of the neutral point. Specifically, a determined hydraulic factor(s) may be used to substitute for a torque and drag factor to be used in the torque and drag calculation of the neutral point and/or may be used to determine a torque and drag factor. For example, an effective weight (buoyed weight) is one of the fundamental torque and drag factors used in the neutral point computation. The effective weight in a vertical section of borehole 14 is given by the following equation:

$$Weff = W\text{air}(1-\text{Mud Density}/\text{Metal Density}) \quad (1),$$

where Weff represents the effective weight and Wair represents weight in air. On the other hand, an effective density of the fluid allowing for the suspended cuttings may be a hydraulic factor. The effective density is given by the following equation:

$$\text{Effective Density} = y*\text{Cutter Density} + (1-y)*\text{Mud Density} \quad (2),$$

where y represent a relative amount/ratio of drilled cuttings (by volume) to the fluid volume in the annulus and is determined by the following equation:

$$y = (Tbu*(dD/dt)(PI*dbit*dbit/4))/Vbu \quad (3),$$

where Tbu, Vbu are the respective bottoms up time (for the selected pump flowrate) and annular volume, dD/dt is the rate of penetration, and dbit is the bit diameter. The effective density (hydraulic factor) may be used to substitute for the Mud Density used in the Torque and Drag computation of the effective weight in equation (1), which can make the determination of the effective weight and thus the neutral point more accurate. The effective density is just one example of hydraulic factors. Other hydraulic factor(s) may also be incorporated into the torque and drag computation of the neutral point.

To this extent, process S3 may include two sub-processes. In sub-process S3-1, hydraulic factor determining unit 32 determines the value (quantity) for each hydraulic factor based on the depth-time log data from measurement device 20. In sub-process S3-2, torque and drag engine 30 determines the neutral point based on the torque and drag factor(s) and the hydraulic factor(s) that are used to substitute for a torque and drag factor(s) or to calculate a torque and drag factor. According to an embodiment, process S3 is implemented in substantially real time by processing center 22 and the determined neutral point is relevant to a specific time point in the drilling process.

Figure 4:
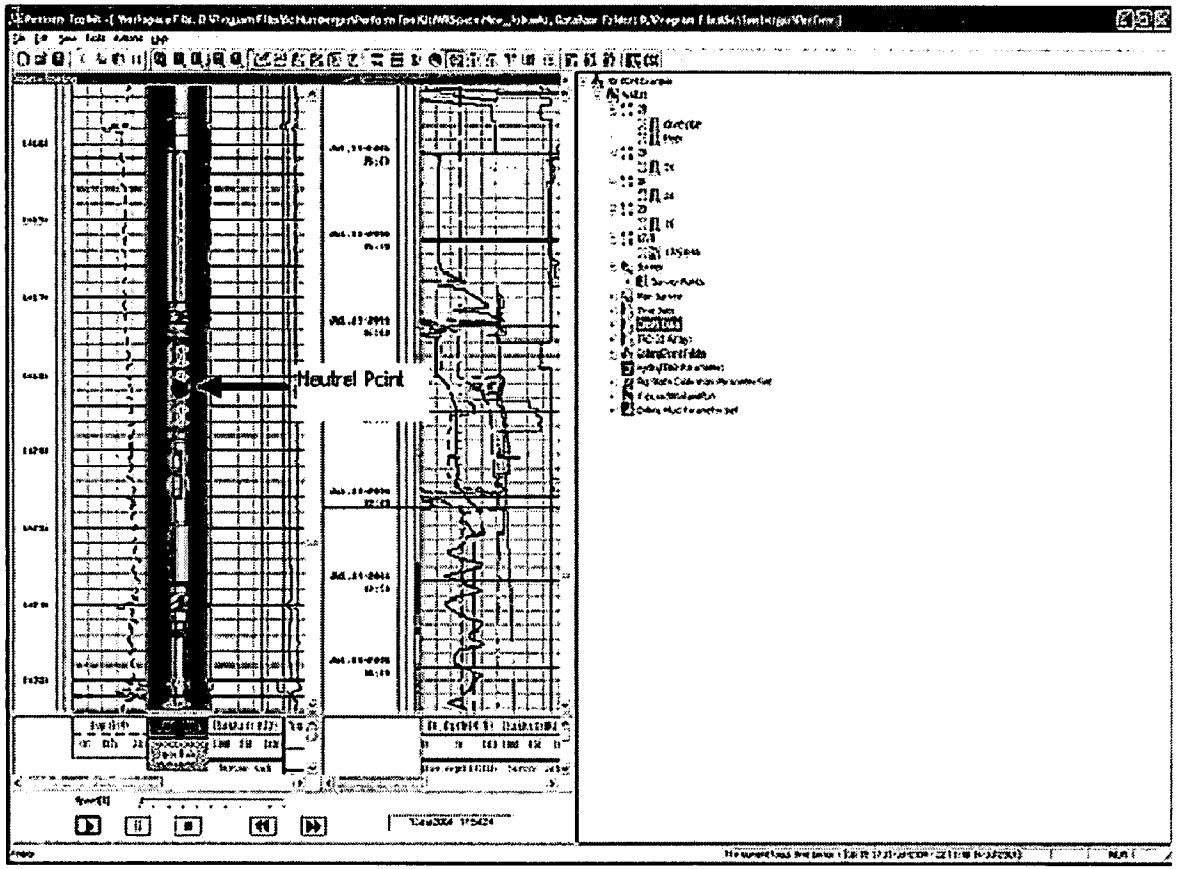
FIG. 4 shows displaying a determined neutral point on the bottomhole assembly sketch.

In process S4, neutral point locating unit 34 locates the neutral point on a component of drillstring 12. Any solution may be used for the locating. For example, the length of each component of drillstring 12 may be determined in substantially real time together with neutral point determination. Then the neutral point may be located on a specific component. Note that the neutral point is determined as a point on drillstring 12 with respect to the length thereof. According to an embodiment, the determined neutral point may be displayed on the BHA sketch as shown in FIG. 4, a screenprint of an exemplary displaying.

In process S5, time pattern analyzing unit 36 analyzes a time related pattern of the neutral point staying on a component. Note that during the process of the drilling, the neutral point may move. For example, the neutral point may first stay on component A then move to component B and then move back to component A. Any time related pattern may be analyzed. For example, according to an embodiment, time pattern analyzing unit 36 may analyze when the neutral point stays on a component, how long the neutral point stays there, and when the neutral point comes back. Time pattern analyzing unit 36 may also analyze how frequently a component experiences switches between compression stress state and tension stress state due to the movement of the neutral point.

In process S6, drillstring optimizing unit 38 controls optimizing drillstring 12 based on the results of at least one of processes S3-S5. For example, drillstring optimizing unit 38 may instruct control mechanism 18 to manipulate the neutral point to stay in a desired position/component of drillstring 12. Drillstring optimizing unit 38 may also output the results to user 44 to redesign drillstring 12. For example, if it is determined that a component originally designed to be in compression stress actually experiences tension stress, the component may be redesigned to fit the requirement of tension stress environment. Other solutions to optimize drillstring 12 are also possible.

3. CONCLUSION

While shown and described herein as a method and system for determining a neutral point of a drillstring in drilling a borehole, it is understood that the invention further provides various additional features. For example, in an embodiment, the invention provides a program product stored on a computer-readable medium, which when executed, enables a computer infrastructure to determine a neutral point of a drillstring in drilling a borehole. To this extent, the computer-readable medium includes program code, which when executed by a computer system, enables the computer system to implement processing center 22 (FIG. 1), which operates the process described herein. It is understood that the term "computer-readable medium" comprises one or more of any type of tangible embodiment of the program code. In particular, the computer-readable medium can comprise program code embodied on one or more portable storage articles of manufacture (e.g., a compact disc, a magnetic disk, a tape, etc.), on one or more data storage portions of a computing device, such as memory and/or other storage system, and/or as a data signal traveling over a network (e.g., during a wired/wireless electronic distribution of the program product).

In addition, a method of providing a system for determining a neutral point of a drillstring in drilling a borehole is included. In this case, a computer infrastructure, such as process center 22 (FIG. 1), can be obtained (e.g., created, maintained, having been made available to, etc.) and one or more systems for performing the process described herein can be obtained (e.g., created, purchased, used, modified, etc.) and deployed to the computer infrastructure. To this extent, the deployment of each system can comprise one or more of: (1) installing program code on a computing device, such as processing center 22 (FIG. 1), from a computer-readable medium; (2) adding one or more computing devices to the computer infrastructure; and (3) incorporating and/or modifying one or more existing systems of the computer infrastructure to enable the computer infrastructure to perform the processes of the invention.

As used herein, it is understood that the terms "program code" and "computer program code" are synonymous and mean any expression, in any language, code or notation, of a set of instructions that cause a computing device having an information processing capability to perform a particular function either directly or after any combination of the following: (a) conversion to another language, code or notation; (b) reproduction in a different material form; and/or (c) decompression. To this extent, program code can be embodied as one or more types of program products, such as an application/software program, component software/a library of functions, an operating system, a basic I/O system/driver for a particular computing and/or I/O device, and the like. Further, it is understood that the terms "component" and "system" are synonymous as used herein and represent any combination of hardware and/or software capable of performing some function(s).

The flowcharts and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems which perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

While the disclosure has been particularly shown and described with reference to exemplary embodiments thereof, it will be understood by those of ordinary skilled in the art that various changes in form and details may be made therein without departing from the spirit and scope of the present invention as defined by the claims. In addition, those of ordinary skill in the art appreciate that any arrangement which is calculated to achieve the same purpose may be substituted for the specific embodiments shown and that the invention has other applications in other environments.

We claim:

1. A method for determining an effective weight of a drillstring in drilling a borehole, the method comprising:

(a) receiving depth-time log data for drilling the borehole with the drillstring using a computer, the depth-time log data including data related to a torque and drag factor and data related to a hydraulic factor;

(b) determining the hydraulic factor, at a time point during the drilling using the computer, based on a Effective density, which is defined as:

Effective Density=y*Cutter Density+(1−y)*Mud Density, wherein y represents a relative ratio of drilled cuttings to the fluid volume in an annulus between the drillstring and the borehole, and y is defined as:

y=(Tbu*(dD/dt)(PI*dbit*dbit/4))/Vbu, wherein Tbu and Vbu represent a respective bottoms up time for a selected pump flowrate and annular volume, dD/dt represents a rate of penetration, and dbit represents a bit diameter;

(c) determining the effective weight of the drillstring, wherein the effective weight of the drillstring is defined as:

Weff=Wair(1−Effective Density/Metal Density), wherein Wair represents weight of the drillstring in the air; and (d) factoring in the determined effective weight when continuing drilling operations.

2. The method of claim 1, wherein at least one of the receiving and the determining is implemented in substantially real time.

* * * * *